US006261444B1

(12) United States Patent
Forse

(10) Patent No.: US 6,261,444 B1
(45) Date of Patent: Jul. 17, 2001

(54) STORM SEWER FILTERING APPARATUS

(76) Inventor: J. Mark Forse, 5401 Progress Blvd., Bethel Park, PA (US) 15102

( * ) Notice: Subject to any disclaimer, the term of this patent is extended or adjusted under 35 U.S.C. 154(b) by 0 days.

(21) Appl. No.: 09/099,787

(22) Filed: Jun. 18, 1998

(51) Int. Cl.[7] ..... E03F 5/06

(52) U.S. Cl. ..... 210/163; 210/164; 210/232; 210/459; 210/448; 210/489; 404/4; 383/22; 383/119

(58) Field of Search ..... 210/163–166, 210/232, 497.2, 314, 448, 315, 452, 337, 483, 455, 485, 489, 459; 404/2, 4; 383/12, 17, 20, 22, 119, 6

(56) References Cited

U.S. PATENT DOCUMENTS

| | | | | |
|---|---|---|---|---|
| 598,611 | * | 2/1898 | Lane . | |
| 1,844,872 | * | 2/1932 | Shipman . | |
| 2,696,235 | * | 12/1954 | Toffolon . | |
| 3,282,430 | | 11/1966 | Kinne | 210/162 |
| 3,713,539 | | 1/1973 | Thompson et al. | 210/164 |
| 4,457,456 | * | 7/1984 | Derby et al. . | |
| 5,345,741 | * | 9/1994 | Slater et al. . | |
| 5,372,714 | * | 12/1994 | Logue, Jr. . | |
| 5,562,819 | | 10/1996 | Turner, Jr. et al. | 210/85 |
| 5,575,925 | * | 11/1996 | Logue, Jr. . | |
| 5,587,072 | | 12/1996 | Regan | 210/232 |
| 5,595,457 | | 1/1997 | Stucks | 405/87 |
| 5,607,237 | * | 3/1997 | LaFleur . | |
| 5,632,888 | | 5/1997 | Chinn et al. | 210/163 |
| 5,632,889 | | 5/1997 | Tharp | 210/165 |
| 5,643,445 | | 7/1997 | Billias et al. | 210/162 |
| 5,679,246 | | 10/1997 | Wilcox et al. | 210/165 |
| 5,699,564 | * | 12/1997 | Heh . | |

* cited by examiner

*Primary Examiner*—David A. Simmons
*Assistant Examiner*—Fred Prince
(74) *Attorney, Agent, or Firm*—John Gugliotta

(57) ABSTRACT

A storm sewer filtering apparatus is provided having a filter bag forming a rectangularly shaped substrate retaining volume. A flat bottom surface remains at the bottom of the filter bag and forms the majority of the filtering surface. Geotextile fabric forms a filtering media and incorporates a plurality of woven webbing reinforcement straps to provide additional strength to the finished filter bag. The woven webbing is affixed to the geotextile filtering media by conventional stitching methods, and extends beyond the edge of the respective sidewall for attachment to a drain grate. Rigidly affixed to each terminal end of the attachment strap is a retaining block that is linearly elongated and made of a rigid material, such as wood, metal, or hard plastic.

9 Claims, 3 Drawing Sheets

STORM SEWER FILTERING APPARATUS

RELATED APPLICATIONS

No public disclosure has been made prior to the filing of this application, and no applications were previously pending or remain co-pending anywhere in the world.

BACKGROUND OF THE INVENTION

1. Field of the Invention

The present invention relates generally to storm water collection systems and, more particularly, to storm sewer filtering devices.

2. Description of the Related Art

As is familiar to one skilled in the performance of various types of road construction, a problem occurs during this activity from both the disturbing of the groundcover and the grading in that excessive erosion and particulate runoff can occur during periods of construction. This can become a significant problem if not dealt with properly and continuously, in that solids can overwhelm the design of water runoff systems in place, and cause occasional local flooding that may interfere with the construction area. Although dewatering systems are known for earthworks and larger construction sites, such are not always feasible for repair work of existing highway infrastructure projects.

Numerous attempts have been made to correct for the foregoing problems. However, none appear to adequately address the problem. For example, U.S. Pat. No. 5,679,246, issued in the name of Wilcox et al., appears to be for holding oil spills and allowing water to filter past. And, U.S. Pat. No. 5,632,889, issued in the name of Tharp, addresses the problem of pollution control, especially liquid hydrocarbons and runoff water on roadways. This invention also teaches a wire basket that uses interchangeable textile liners.

Further, U.S. Pat. No. 5,372,714, issued in the name of Regan, describes several filter nettings connected together with quick release fasteners for easy replacement of filters, or removal of debris.

Also, U.S. Pat. No. 5,632,888, issued in the name of Chin et al., and assigned to Dandy Enterprises of Grove City, Ohio, incorporates a two-stage filtering system, with stage one being an envelope filter system extending down an inlet, and stage two being a textile product on a roll that extends only a few inches into the inlet and capable of being replaced periodically.

And, U.S. Pat. No. 5,643,445, issued in the name of Billias et al., discloses a more permanent filtering mechanism rather than a temporary one, U.S. Pat. No. 3,713,539, issued in the name of Thompson et al., discloses a strainer device for used in everything from sinks to drainage systems, and U.S. Pat. No. 5,562,819, issued in the name of Turner, Jr. et al., discloses a permanent filtering system for underground water or storm drains.

In a very recently issued patent U.S. Pat. No. 5,595,457, issued in the name of Stucks, a number of emergency runoff scenarios are dealt with by the inventor.

Other patents were examined and discarded as irrelevant. These were: U.S. Pat. No. 5,294,337; and U.S. Pat. No. 4,388,191.

Of considerable relevance are two U.S. Pat. Nos., 5,372,714 and 5,575,925, both issued in the name of Longue, Jr. The second of these is actually a continuation in part of the first, with each having identical specifications. Of particular interest are the claims of these patents: in U.S. Pat. No. 5,372,714, the catch basin itself is claimed as an integral part of the invention, in combination with a filter grate for holding a filter bag; in U.S. Pat. No. 5,575,925, the filter bag itself is claimed in greater detail. Further, also the specifications of these references make claims of tensile strength adequate to hold up to 4,000 pounds of silt, a device based upon these references does not achieve this in practice according to the design as disclosed, claimed, and anticipated. Further, such a device having a "v" shaped lower container body creates excessive pressure along the lower vortex, thereby placing additional stresses on the unreinforced geotexile material and further limiting the effective solids capacity and reusability of such a device.

While some of the features of these prior references are incorporated into the present invention in combination, other elements are different enough as to make the combination distinguished the prior art.

SUMMARY OF THE INVENTION

It is therefore an object of the present invention to provide an improved storm sewer filtering apparatus that is not integrally incorporated into either the catch basin or the sewer grate.

It is a feature of the present invention to provide an improved storm sewer filtering apparatus that is reinforced in such a manner as to allow for a silt capacity of 800 to 1000 pounds to be repeatably achieved in practice.

Briefly described according to one embodiment of the present intention a storm sewer filtering apparatus is disclosed for use in filtering sediment from surface water and preventing solids from entering a convention storm sewer collection basin. The apparatus includes a filter bag 12 forming a rectangularly shaped substrate retaining volume. A flat bottom surface remains at the bottom of the filter bag and forms the majority of the filtering surface. Geotextile fabric forms a filtering media to form the first sidewall, second sidewall, first endwall, second endwall, and bottom. Further, a plurality of reinforcement means are provided for adding strength to the finished filter bag. Each reinforcement means is formed conventional textile reinforcement webbing, such as is readily available for use in automobile seat belts, airplane seat belts, and various types of belts and harnesses. A pair of such first reinforcement straps are affixed horizontally along each of the first endwall and the second endwall respectively. A plurality of second reinforcement straps are affixed parallely vertically along the first sidewall, across the bottom, and subsequently vertically up the second sidewall respectively in a consecutive manner. Each second reinforcing strap extends beyond the edge of the respective sidewall for attachment to a drain grate. Rigidly affixed to each terminal end of the attachment strap is a retaining block made of a rigid material, such as wood, metal, or hard plastic.

An advantage of the present invention is that it is formed of a larger overall volume, allowing for a greater silt accumulation capacity per catch basin design than would other designs.

Another advantage of the present invention is that a flat bottom area allows for a larger drainage area, thereby hindering clogging and facilitating fluid flow therethrough.

Further, a preferred embodiment of the present invention has reinforced webbing, allowing a larger capacity to be safely held and transported.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
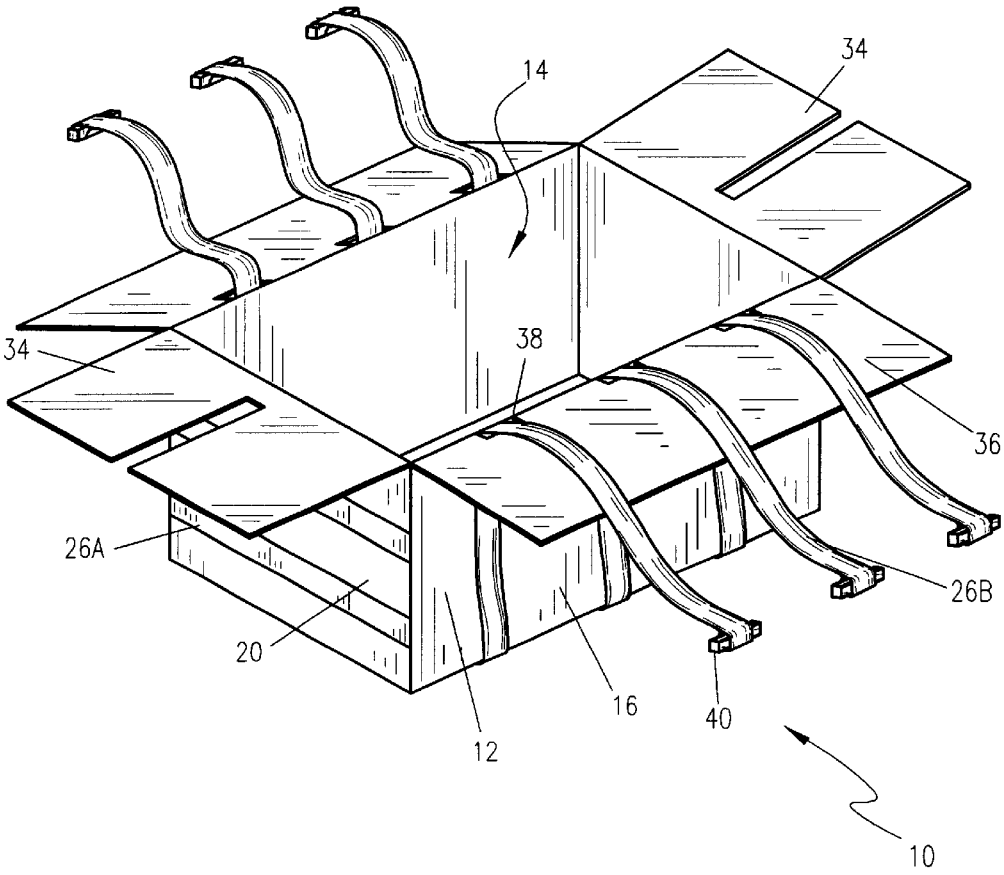
FIG. 1 is a perspective view of a storm sewer filtering apparatus according to the preferred embodiment of the present invention.
Figure 2:
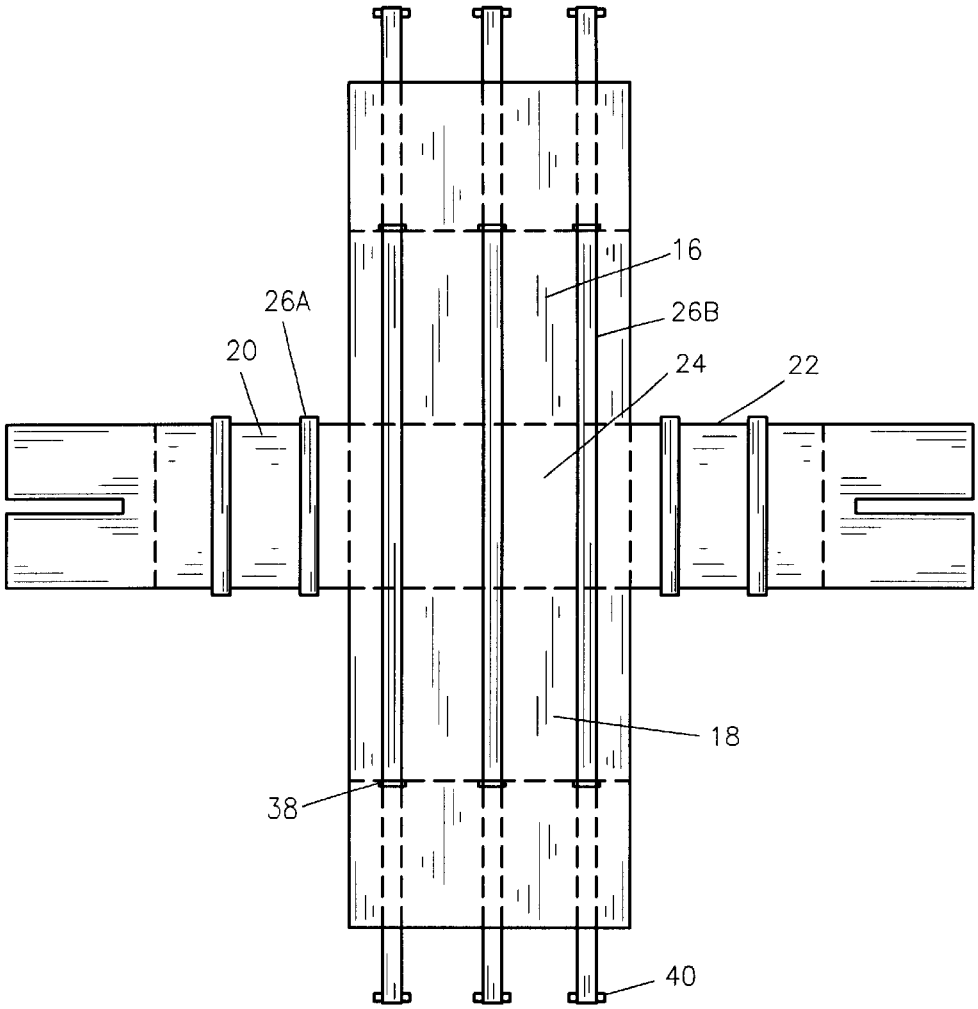
FIG. 2 is an exploded bottom plan view thereof, shown as a flattened pattern that, when assembled, forms the filtering apparatus of FIG. 1.

Referring now to FIG. 1, a storm sewer filtering apparatus 10 is shown, according to the present invention, for use in filtering sediment from surface water and preventing solids from entering a convention storm sewer collection basin. The apparatus 10 includes a filter bag 12 forming a rectangularly shaped substrate retaining volume, indicated as 14. As best seen in conjunction with FIG. 2, the filter bag 12 is formed by a first sidewall 16 opposite a second sidewall 18, and each perpendicularly seamed with a first endwall 20 opposite a second endwall 22 in a manner such that a pattern for the filter bag 12 can be generated by a flat cross shaped member functioning as a pattern (as shown in FIG. 2), and wherein by sewing or otherwise affixing adjacent seams a generally rectangular filter bag 12 (as shown in FIG. 1) can be formed. A flat bottom surface 24 remains at the bottom of the filter bag 12 and forms the majority of the filtering surface.

Because it has been found in practice that the use of geotextile fabric forms an adequate and effective filtering media for the intended application, the preferred embodiment incorporates the same use to form the first sidewall 16, second sidewall 18, first endwall 20, second endwall 22, and bottom 24. It is envisioned, however, that the use of other filtering media is capable of functioning as an equivalent for use in the present teachings. Further, in practice is has been found that because of the nature of the intended application, any filtering media will be limited in its practical ability to retain a large mass of substrate. Therefore, the present invention incorporates a plurality of reinforcement means 26 to provide additional strength to the finished filter bag 12.

Specifically, referring to FIG. 2 it is envisioned that in its preferred embodiment each reinforcement means 26 would be comprised of conventional textile reinforcement webbing, such as is readily available for use in automobile seat belts, airplane seat belts, and various types of belts and harnesses. The woven webbing is lightweight, flexible, has an extremely high strength to weight ratio, can be purchased inexpensively. Further, due to the woven nature of the webbing it can be easily affixed to the geotextile filtering media by conventional stitching methods, as will thereafter further allow for the drainage of filtrate therethrough, thereby unhindering the filtering ability of the filter bag 12.

For purposes of disclosure of the preferred embodiment, and not by way of limitation, in its specific application the reinforcement means is disclosed as a pair of such first reinforcement straps 26A affixed horizontally along each of the first endwall 20 and the second endwall 22 respectively. It is found that this provides sufficient holding strength to the endwalls to assist the geotextile fabric in retaining large masses of substrate. Further, a plurality of second reinforcement straps 26B (comprising at least two and envisioned herein as three) are affixed parallely vertically along the first sidewall 16, across the bottom 24, and subsequently vertically up the second sidewall 18 respectively in a consecutive manner. It is found that such a configuration provides superior substrate retaining strength to the geotextile fabric forming the sidewalls and bottom of the filter bag 12. Each second reinforcing strap 26B is anticipated as extending beyond the edge of the respective sidewall for attachment to a drain grate in a manner that will be described in greater detail below.

Figure 3:
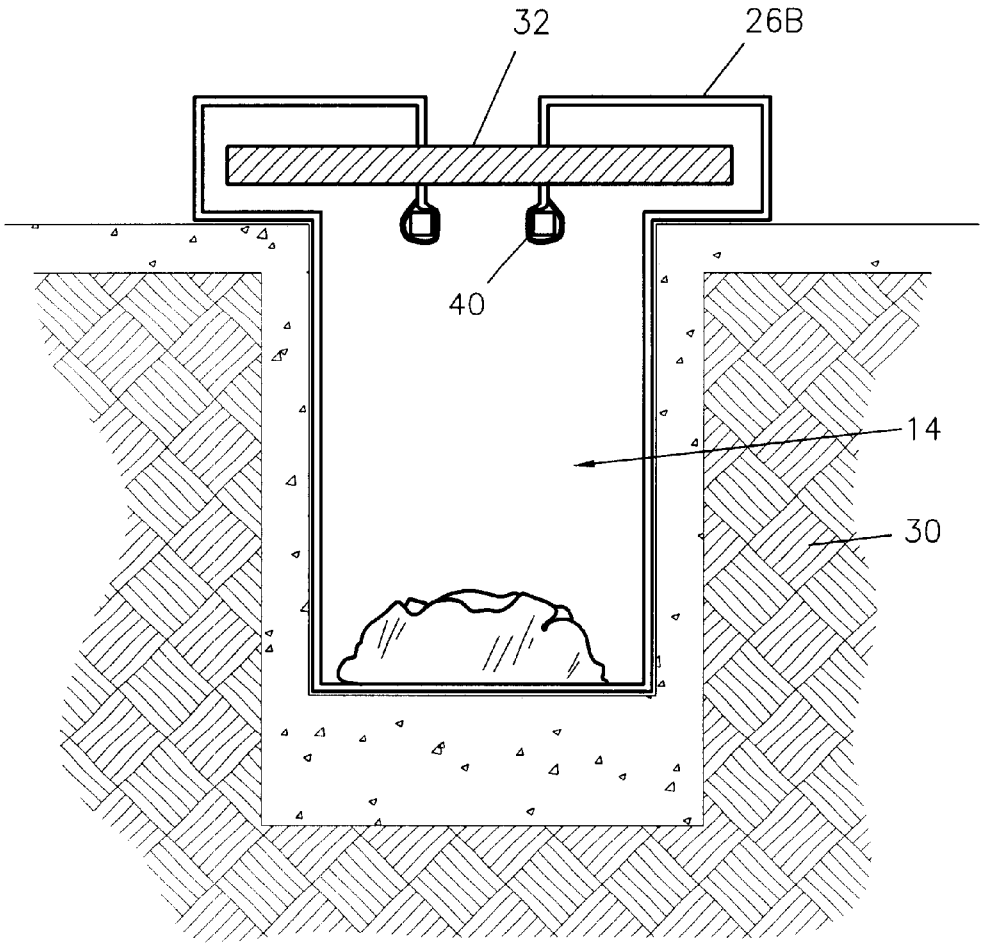
FIG. 3 is a cross sectional view taken along the horizontal centerline of a storm sewer filtering apparatus of the present disclosure shown installed in a typical storm retention basin.

FIG. 3, in combination with FIG. 2 and FIG. 1, shows the structural features that allow attachment of the apparatus 10 to an otherwise conventional water collection basin 30 of the type used in storm sewer collection systems and having an otherwise conventional grate 32 covering the upper opening of the basin 30. As is shown, each endwall 20, 22 extends linearly beyond the filter bag opening 14 in a manner that forms a first retaining flap 34, herein shown as a fabric segment eight inches in length. Similarly, each sidewall 16, 18 extends linearly beyond the filter bag opening 14 in a manner that forms a second retaining flap 36, herein shown as a fabric segment twelve inches in length. Because the attachment strap 26B reinforces the sidewalls and bottom from the exterior surface, but is required to be above the second retaining flap 36 for attachment purposes, as will be described in further detail below, it is envisioned that a strap penetration orifice 38 is formed at the seam between the sidewall 16,18 and the second retaining flap 34 such as to allow the attachment strap 26B to penetrate therethrough.

Finally, rigidly affixed to each terminal end of the attachment strap 26B is a retaining block 40. It is envisioned that each retaining block 40 is linearly elongated and made of a rigid material, such as wood, metal, or hard plastic.

2. Operation of the Preferred Embodiment

In accordance with a preferred embodiment of the present invention, as shown best in FIG. 3, the storm sewer filtering apparatus 10 is shown in use with a conventional water collection basin 30. As is common throughout the art, such basins are generally supplied with a covering grate 32, usually made of a rigid metal material, that restrains large objects such as people from falling into the collection basin 30. In use, the grate is temporarily removed and the filter bag 12 is placed within the basin 30. The flaps 34, 36 are then extending outward over the top edge of the basin 30 and subsequently frictionally impinged between the grate 32 and the basin's upper edge. The attachment straps 26B are extended outward past the edge of the grate 30, and subsequently looped around the grate 30 through any grate orifice that is available. This is intended to be accomplished by twisting the retaining block 40 in a manner to align it's narrowest dimension to align with the grate orifice and inserting the retaining block 40 therethrough. Once inserted, the retaining block 40 can be manipulated such that the lateral length of the block 40 extends beyond the boundaries of the grate orifice such that mechanical impingement between the retaining block 40 and the grate 30 create a firm retaining connection to hold the filter bag 12 in place.

The foregoing description is included to illustrate the operation of the preferred embodiment and is not meant to limit the scope of the invention. The scope of the invention is to be limited only by the following claims.

What is claimed is:

1. A storm sewer filtering apparatus for use in filtering sediment from surface water and preventing solids from entering a convention storm sewer collection basin, said apparatus comprising:

a filter bag forming a rectangularly shaped substrate retaining volume, said filter bag formed by a first sidewall opposite a second sidewall, and each perpendicularly seamed with a first endwall opposite a second endwall in a manner such that a pattern for the filter bag can be generated by a flat cross shaped member functioning as a pattern, and having a flat bottom surface remaining at the bottom of the filter bag, opposite a filter bag opening, and forming the majority of the filtering surface; and a plurality of reinforcement means to provide additional strength to the finished filter bag at the first sidewall, the second sidewall, the first endwall, the second endwall, and the flat bottom surface.

2. The storm sewer filtering apparatus of claim 1, wherein geotextile fabric forms the first sidewall, second sidewall, first endwall, second endwall, and bottom.

3. The storm sewer filtering apparatus of claim 1, wherein said reinforcement means is comprised of conventional textile reinforcement webbing affixed to the geotextile filtering media by conventional stitching methods.

4. The storm sewer filtering apparatus of claim 3, wherein said reinforcement means comprises a pair of such first reinforcement straps affixed horizontally along each of the first endwall and the second endwall respectively.

5. The storm sewer filtering apparatus of claim 4, wherein said reinforcement means further comprises a plurality of second reinforcement straps affixed parallely vertically along the first sidewall, across the bottom, and subsequently vertically up the second sidewall respectively in a consecutive manner.

6. The storm sewer filtering apparatus of claim 5, wherein each second reinforcing strap extends beyond the edge of the respective sidewall for attachment to a drain grate.

7. The storm sewer filtering apparatus of claim 6, further comprising attachment means for allowing attachment of the apparatus to an otherwise conventional water collection basin used in storm sewer collection systems and having an otherwise conventional grate covering the filter bag opening of the basin.

8. The storm sewer filtering apparatus of claim 7, wherein said reinforcement means extends linearly beyond the filter bag opening in a manner that forms a first retaining flap forming a fabric segment eight inches in length, and each sidewall extends linearly beyond the filter bag opening in a manner that forms a second retaining flap twelve inches in length, and further comprising a strap penetration orifice formed at the seam between the sidewall and the second retaining flap such as to allow the attachment strap to penetrate therethrough.

9. The storm sewer filtering apparatus of claim 8, wherein said reinforcement means further comprises a retaining block rigidly affixed to each terminal end of the attachment strap, each retaining block being linearly elongated and made of a rigid material.

* * * * *